United States Patent [19]

Stein

[11] 4,280,229

[45] Jul. 28, 1981

[54] MATERNITY CLOTHING GARMENT

[76] Inventor: Paul Stein, 24 Viewhill Rd., North Balwyn, Victoria, 3104, Australia

[21] Appl. No.: 126,961

[22] Filed: Mar. 3, 1980

[51] Int. Cl.[3] ..... A41D 1/14

[52] U.S. Cl. ..... 2/221

[58] Field of Search ..... 2/221, 220, 236, 237, 2/76

[56] References Cited

U.S. PATENT DOCUMENTS

| | | | |
|---|---|---|---|
| 1,652,914 | 12/1927 | Snell | 2/220 |
| 2,492,097 | 12/1949 | Katz | 2/76 |
| 3,505,685 | 4/1970 | Granchelli | 2/221 |
| 3,732,576 | 5/1973 | Gauthier | 2/221 |

*Primary Examiner*—Doris L. Troutman

*Attorney, Agent, or Firm*—Samuelson & Jacob

[57] ABSTRACT

A maternity clothing garment having a body portion comprising leg or skirt regions and a waist portion having a relatively vertically larger panel of elastically expansible and conformable ribbed knitted material extending circumferentially along the waist portion at the front of the garment, and a relatively vertically smaller panel of elastically expansible and conformable ribbed knitted material extending circumferentially along the waist portion at the rear of the garment, whereby the panels will conform to the shape of the wearer.

7 Claims, 3 Drawing Figures

MATERNITY CLOTHING GARMENT

Figure 1:
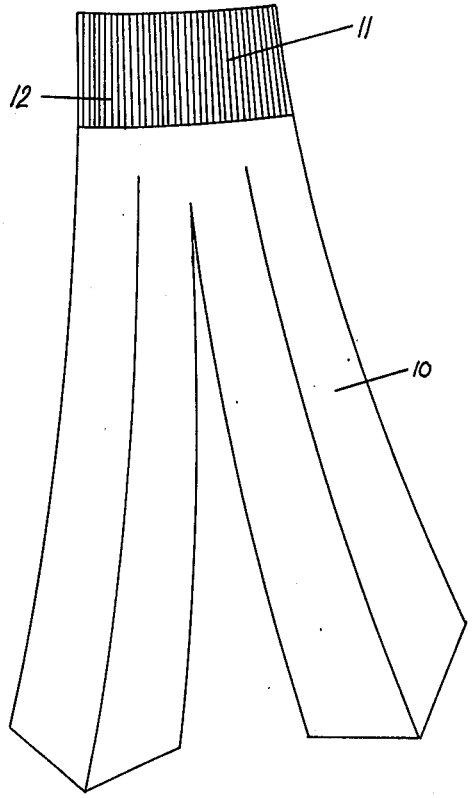

The present invention relates to improvements in maternity clothing, particularly slacks, shorts and skirts.

It is a well known problem of pregnancy that women require varying sized garments to provide comfort and an attractive appearance during successive stages of pregnancy. This necessarily means that existing garments require continual adjustment and or modification, or new garments must continually be purchased to adjust for the varying size of the wearer. Furthermore, it is often necessary for special garments, which are solely of use during pregnancy, to be purchased. Such garments cease to be wearable after the birth of the baby and consequently are not fully used for the normal period of time that clothing garments are usually worn. In all the above situations, considerable expense is incurred and the mother is eventually left with garments which are of no practical use after child birth.

There have been several attempts to provide clothing garments which adjust to the wearers shape during pregnancy. One such attempt has involved the use of physically adjustable garments having a plurality of adjustment points to allow the wearer to periodically adjust the size of the garment. The disadvantages of such garments are principally that they are not particularly attractive, they still require some effort to adjust their size, and they are normally discarded after completion of the pregnancy. Another attempt to provide a continually adjustable clothing garment has involved including in the garment one or more shirred panels located in the front of the garment where the major expansion capability is required. The panels of such garments have included concertina folds of the material of the garment connected by an elastic thread or the like. These panels have allowed expansion by extension of the concertina folds. One of the main disadvantages of these garments is that considerable quantities of material is needed for the concertina folds. In addition, the panels are relatively bulky and are therefore uncomfortable and unattractive and in addition they have only a limited extension beyond which further expansion is impossible. It has further been found that such garments having substantially rigid rear panels give insufficient support for the back regions of the wearer, particularly when the wearer leans forwardly.

It is therefore an object of the present invention to provide an improved maternity garment suitable for use during all stages of pregnancy without the need for any specific alteration by the wearer. It is also intended to provide a maternity garment which can be worn before and after pregnancy with at least equal effectiveness, comfort and appearance as that achieved during pregnancy.

In accordance with the aforementioned objectives, the present invention provides a maternity garment having in combination a waist portion and a body portion secured thereto, the body portion forming the shape of the garment and the waist portion having at least one large panel of ribbed knitted material being elastically deformable in at least the direction transverse to the ribs of said material to conform to the shape of the wearer.

Conveniently the body portion of the garment is formed integrally with the panel of ribbed material and may itself consist of a substantially non-elastic knitted or woven material to maintain a relatively attractive appearance of the garment as a whole. The formation of the elastic panel as described in the foregoing provides an attractive, non-bulky means for conforming to the varying shape of a mother during pregnancy. The body portion of the garment may, in known manner, be formed in the configuration of slacks, shorts or skirt.

Advantageously the panel of ribbed knitted material is arranged in the front of the garment, the waist portion being completed by a further smaller band of elastic webbing. The larger panel is preferably at least 9 inches in depth and the ribs running generally in a vertical direction.

A second preferred embodiment of the present invention provides a garment wherein the waist portion includes at least one panel of elastically deformable material in the rear regions of the waist portion. This is particularly advantageous as it provides considerably increased support and comfort for the wearer in the back of the garment where stress often occurs during pregnancy. The waist portion may be formed by a panel of ribbed knitted material extending circumferentially around the garment. The depth of the circumferential panel may be the same at all positions around the waist, however, it is preferred to have the largest depth of panel located in the front of the garment. A suitable example of this type of garment has a panel of about 9 inches depth in the front and a panel of 5 inches in the back.

The present invention will now be described with reference to two preferred embodiments illustrated in the accompanying drawings. In the drawings:

FIG. 1 is a front view of a first preferred embodiment of the invention.

Figure 1A:
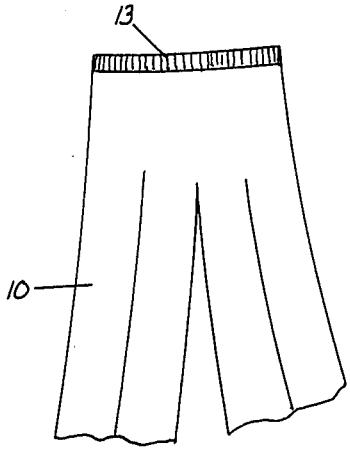

FIG. 1*a* is a rear view of the garment illustrated in FIG. 1*a*; and

Figure 2:
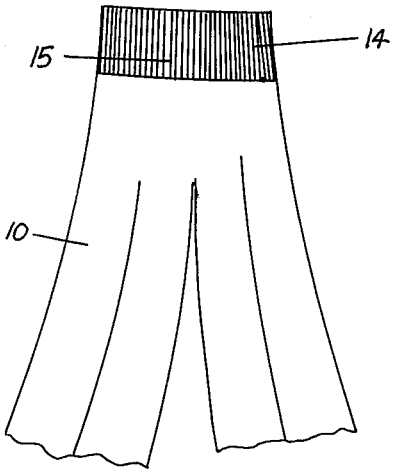

FIG. 2 is a rear view of a second preferred embodiment of the invention.

Referring to FIGS. 1 and 1*a* there is illustrated front and rear views of slacks for maternity wear. The slacks comprise conventional leg regions 10 and a front panel 11 of elastic knitted ribbed material extending from the waist downwardly about a distance of 9 inches. The ribs 12 of the knitted panel 11 extend generally in the longitudinal direction of the leg regions 10 whereby the panel is expandable in a direction parallel to the waist opening of the garment. The panel 11 preferably extends around about 180° of the circumference of the waist and is produced from a material having sufficient elasticity without the need for shirring as is commonly used in expanding garments. Polyesters provide suitable fibres for producing such a knitted panel. This enables the panel to expand and contract without restriction which is a disadvantage of shirred garments. As is illustrated in FIG. 1*a* an elastic band 13 extends around the rear of the waist region of the garment. The band 13 has only a short width to provide sufficient elasticity and support to enable the slacks to be worn comfortably.

Referring to FIG. 2 there is illustrated an alternative embodiment similar to the slacks of FIGS. 1 and 1*a*. The front of the garment is essentially similar to that illustrated in FIG. 1 having a front panel of elastically expandible knitted material. The rear of the garment, however includes a second panel 14 of ribbed elastically expandible material. The ribs 15 of the panel 14 extend generally vertically thereby providing greater transverse elasticity in the waist region. The rear panel 14 may extend over 180° of the waist circumference and may be of shorter length than the front panel. For example, the rear panel may be approximately five inches in length if the front panel is nine inches in length.

It will be appreciated that the previously described clothing garments may be employed for all types of maternity wear. The most usual applications are, however, shorts, slacks and skirts. The elastically deformable panel(s) arranged around the waist of such garments enables the waist region to expand as the wearer expands, thus enabling the garment to be worn through all stages of pregnancy. The garment, however, has the added advantage that it will contract so that it may be used as a normal clothing garment after child birth. This provides prospective mothers with an article of clothing which is economical and which can be worn over long periods of time (including during pregnancy) while retaining an attractive appearance.

I claim:

1. A maternity garment having a front and a back and including in combination, a waist portion; and a body portion integral with the waist portion and extending vertically downwardly from the waist portion;

the body portion having a configuration which forms the shape of the garment; and the waist portion having a relatively vertically larger panel of elastically expansible and comformable ribbed knitted material extending circumferentially along the waist portion at the front of the garment, and a relatively vertically smaller panel of elastically expansible and comformable ribbed knitted material extending circumferentially along the waist portion at the rear of the garment;

the larger panel extending vertically downwardly further than the smaller panel, whereby the waist portion will conform to the shape of the wearer over a range of shape and size variations.

2. The invention of claim 1 wherein the ribbed knitted material includes a plurality a parallel ribs and the ribs of each panel extend essentially vertically along the waist portion, the panels thus being elastically expansible transverse to the ribs thereof, in essentially circumferential directions.

3. The invention of claim 1 or 2 wherein the larger panel extends over about 180° of the circumference of the waist portion.

4. The invention of claim 3 wherein the smaller panel extends over about 180° of the circumference of the waist portion.

5. The invention of claim 1 or 2 wherein the larger panel has a vertical extent of about nine inches and the smaller panel has a vertical extent of about five inches.

6. The invention of claim 5 wherein the larger panel extends over about 180° of the circumference of the waist portion.

7. The invention of claim 6 wherein the smaller panel extends over about 180° of the circumference of the waist portion.

* * * * *